US005524872A

United States Patent [19]

Lewin et al.

[11] Patent Number: 5,524,872

[45] Date of Patent: Jun. 11, 1996

[54] CLAMPING DEVICE

[75] Inventors: George Lewin, Brighton; Raymond L. Robinson, The Basin; Maurice W. Anglin, Park Orchards; Jack Zacupek, Nunawading; Andrew Cox, Frankston, all of Australia

[73] Assignee: Triton Technologies Pty Ltd, Australia

[21] Appl. No.: 107,738

[22] PCT Filed: Feb. 25, 1992

[86] PCT No.: PCT/AU92/00077

§ 371 Date: Aug. 25, 1993

§ 102(e) Date: Aug. 25, 1993

[87] PCT Pub. No.: WO92/14581

PCT Pub. Date: Sep. 8, 1992

[30] Foreign Application Priority Data

Feb. 25, 1991 [AU] Australia ..... PK4785

[51] Int. Cl.[6] ..... B25B 1/02

[52] U.S. Cl. ..... 269/210; 269/901; 269/158; 269/159

[58] Field of Search ..... 269/88, 79, 158, 269/159, 166–171.5, 208, 210, 212–216, 901, 6; 108/167, 171, 187, 121, 122, 123

[56] References Cited

U.S. PATENT DOCUMENTS

| | | | |
|---|---|---|---|
| 281,463 | 7/1883 | Coram | 269/159 |
| 969,003 | 8/1910 | Thayer . | |
| 1,111,185 | 9/1914 | Schmidt . | |
| 1,417,025 | 5/1922 | Bryan, Jr. . | |
| 1,658,411 | 2/1928 | Morgan | 269/201 |
| 1,915,340 | 6/1933 | Van Berkel | 269/170 |
| 2,588,745 | 3/1952 | McKenzie | 269/167 |
| 2,892,369 | 6/1959 | Millet | 269/159 |
| 4,220,322 | 9/1980 | Hobday | 269/6 |
| 4,747,588 | 5/1988 | Dillhoff | 269/6 |
| 4,909,495 | 3/1990 | Neuenschwander et al. . | |
| 5,009,134 | 4/1991 | Sorensen et al. | 269/166 |
| 5,096,170 | 3/1992 | Albin | 269/6 |
| 5,120,035 | 6/1992 | Neuenschwander et al. . | |
| 5,217,213 | 6/1993 | Lii | 269/6 |

*Primary Examiner*—Robert C. Watson

*Attorney, Agent, or Firm*—Dennison, Meserole, Pollack & Scheiner

[57] ABSTRACT

A clamping device comprising a support structure (1) carrying a first jaw (3) which is fixed relative to the support structure and a movable jaw (6) capable of moving towards the fixed jaw to effect clamping. The movable jaw is operated by a lever (10) which engages an advancing means wherein said lever incorporates a locking means to secure the movable jaw at any given position and applied force.

27 Claims, 4 Drawing Sheets

CLAMPING DEVICE

FIELD OF THE INVENTION

This invention relates to clamping devices such as vices for the clamping of workpieces between a pair of clamping jaws at a safe and comfortable height.

BACKGROUND OF THE INVENTION

The most common clamping device in current use is the vice having a fixed jaw and a moving jaw carried by a threaded support engaged by a correspondingly threaded shaft for advancing the moving jaw to clamp a workpiece between the two jaws. Most vices are made from machined cast steel and must be bolted to a work bench or other support. For this reason, most vices are not easily portable from one working site to another.

A number of portable clamping devices have been proposed to enable a workman or handyman to conveniently transport the device from one work site to another. One such proposal is shown in European Patent Publication 64883 (82302408.8). This clamping device has an adjustable jaw which is fixed during the clamping operation, and a moving or clamping jaw actuated by a foot operated lever which pivots the jaw from a released position to a clamping position via an overcentring linkage pivoted to the lever and to the moving jaw to lock the moving jaw in its fully clamped position.

While the arrangement described in the above document has the advantage of portability, it does not allow different appropriate clamping forces to be applied depending on the object being clamped and the clamping range is not quickly adjustable, some degree of trial and error being required. Thus, unless the operator's foot is kept on the pedal to apply variable clamping forces lower than that necessary to cause the locking linkage to overcentre, only one clamping force may be maintained on a clamped object using this device, and this force may in many instances be excessive and damage the object being clamped or inadequate and allow the object to slip while being worked on.

Another type of clamping device is described in U.K. Patent Application 2187411. In the device shown in FIGS. 25 to 29, a moving jaw is operated by a spring loaded foot lever to apply a clamping force dictated by the force applied by the operator's foot. However, the operator's foot must be kept on the lever otherwise the spring releases the clamping jaw. This arrangement seriously restricts the activities which may be performed by the operator on the clamped object.

Numerous foot operated vices or clamps are disclosed in the Patent literature. For example, U.S. Pat. Nos. 1,430,260 Bobo and 2,892,369 Millet disclose clamps or vices having a foot operated lever which causes a work piece to be clamped between a fixed jaw and a movable jaw. While in each of these devices, the force applied by the foot operated lever may be varied, each device includes a toothed latching means for locking the foot operated lever when the required force has been reached. Since toothed locking devices can only be operated when the latch is aligned with an intertooth space, the foot operated lever cannot be locked at the desired position since the lever must be moved in either direction from the desired position to achieve the required alignment of the locking device. Furthermore, release of such locking devices often requires the foot operated lever to be pushed past its locked position thereby increasing the clamping force and possibly damaging the clamped object.

STATEMENT OF INVENTION AND OBJECTS

It is an object of a first aspect of the present invention to provide an improved lever operated clamping device capable of being mounted on a portable support and which can be locked at any selected position applying any selected clamping force.

It is an object of a second aspect of the present invention to provide an improved mechanism for rapidly advancing the jaw or jaws to the clamping position and to provide automatic locking at that position.

It is an object of a third aspect of the present invention to provide a rigid supporting structure for a clamping workbench which may be collapsed into a form which is convenient for carrying or stowing.

According to a first aspect, the present invention provides a clamping device comprising a support structure carrying two adjustably spaced apart jaws, lever means pivotally connected to the support structure and operably engaging advancing means for moving one of the jaws relative to the other as the lever means is pivoted to a selected position to apply a selected clamping force to an object between said jaws determined by the force applied to the lever, and locking means for holding the two jaws in any selected position with said selected clamping force applied to the object, said locking means allowing the continuous and infinitely variable locking of said clamping device in any selected position and selected clamping force.

In a preferred form, the locking means comprises a first member adapted to frictionally engage a second member in an infinitely variable manner to hold the jaws in any selected position.

The locking means preferably allows relative movement of said second member in one direction relative to said first member and is operative to lock the lever means as soon as the lever has reached the selected position and ceases pivotal movement in the advancing direction thereby enabling 'hand-free' locking of the clamping device.

In one preferred form, the lever has an operative end to which operating forces are applied, said locking means acting between said support structure and said lever at a position which is closer to said operative end of the lever than its pivotal connection to the support structure.

The locking means preferably includes lock releasing means co-operating with said locking means holding the locking means in its deactivated state to allow the lever means to be reciprocated to repeatedly actuate the advancing means to reduce the space between the jaws in a 'hands-free' manner.

In its presently preferred form, the locking means comprises a plate pivoted to the support structure and having an aperture through which a rod connected to the lever means is free to pass when they are perpendicular to each other, said plate being normally spring biased to an angular position with respect to the rod, so that the edges of the aperture in the plate grip the rod when advancing movement of the lever ceases, to prevent return movement of the lever to thereby lock the advancing means and the moving jaw in any desired position, said locking means having associated means for releasing the locking means when clamping is no longer required.

The lock releasing means may comprise a secondary lever pivoted to the support structure and having an abutment means positioned to engage the plate of said locking means to hold said plate in an orientation substantially perpendicular to the rod to allow the rod to slide freely through the aperture.

In a particularly preferred form of the invention, the support structure comprises an elongate portion defining a track for slidably receiving said jaw(s), and three legs pivotally attached to the elongate portion and comprising two legs pivoted to the elongate portion at the front of the support portion and one leg pivotally mounted at the rear end of the support portion, and collapsible bracing struts extending between said front legs and between said front leg bracing strut and said rear leg to releasably retain said legs in their supporting positions, said front legs being collapsible to lie along either side of the elongate support and said rear leg, lever arm and pedal being collapsible to lie along the length of the support to facilitate collapsing of the support structure into an easily transportable or stowable form.

The front legs preferably have enlarged feet secured to their lower ends and to which the bracing struts are pivotably attached, said feet being positioned to enable the operator to stand on the feet to stabilise the support structure.

In a second aspect, the invention provides a clamping device comprising two adjustably spaced apart jaws carried by a support structure, pivoted lever means carrying advancing means for advancing at least one of said jaws relative to the other jaw, said advancing means including an advancing member having means to engage spaced apertures, teeth or abutments in an elongate back runner of one of said jaws, said advancing member being pivoted to the inner end of said lever means and being spring biased to cause arcuate movement of said advancing member towards the back runner to cause engagement between said engagement means and said spaced apertures, teeth or abutments when the lever means is pivoted in the operative direction, and an abutment finger carried by said support structure for engaging the rear end of said advancing member when the lever is in its retracted position to pivot the advancing member against the action of said spring biasing to position the engagement means clear of the back runner to facilitate free sliding movement of said one of said jaws with respect to said support structure.

In a third aspect, the invention provides a support structure for a clamping workbench, comprising an elongate support carrying two adjustably spaced apart jaws, foot operated lever means pivotally connected to said support and having a foot pedal, said lever means operably engaging advancing means for moving one jaw relative to the other two front support legs pivotally mounted to the elongate support at the one end of the support and one rear support leg pivotally mounted at the other end of the support, collapsible bracing struts extending between said front legs and between said front leg bracing strut and said rear leg to releasably brace said legs in their supporting positions, said front legs being collapsible to lie along either side of the elongate support and said rear leg, said lever arm and foot pedal being collapsible to lie along the length of the support to facilitate collapsing of the support structure into an easily transportable or stowable form.

In a preferred form of the third aspect, the invention provides a clamping workbench comprising a support structure carrying two adjustably spaced apart jaws, foot operated lever means pivotally connected to the support structure and having a foot pedal, said lever means operably engaging advancing means for moving one of the jaws to a selected position relative to the other as the lever means is pivoted to apply a selected clamping force to an object between said jaws determined by the force applied to the lever, and locking means for holding the lever means in any said selected position with said selected clamping force applied to the object, said locking means comprising a first member mounted on said support to lockably engage a second member on said lever, leg means foldably carried by said support structure for supporting said support structure in a stable manner at an elevated position relative to a supporting surface, said legs said lever and said foot pedal being collapsible so as to be positioned adjacent to and along said support structure to render the workbench readily portable or stowable, said second member of said locking means being pivoted to said lever means to allow said lever means to be collapsed without disconnecting said locking means.

The locking means preferably has lock releasing means comprising a lever pivoted to said fixed jaw and configured to enclose said first and second means within said support structure, said lever having an abutment which engages said first means to hold it in a released position relative to said second means to allow repeated 'hands-free' actuation of said lever without locking. In this way the locking means is neatly enclosed by the support structure at the same time allowing collapsing of the clamping workbench for transport or storage.

The front legs preferably have enlarged feet secured to their lower ends and to which the bracing struts are pivotably attached, said feet being positioned to enable the operator to stand on the feet to stabilise the support structure.

In another aspect, the invention provides a locking device for an operating mechanism of a working device such as a clamping device, said operating mechanism including a reciprocatable rod and said locking device comprising a pivoted plate having an aperture through which said rod is free to pass when they are substantially perpendicular, said plate being spring biased to an angular position with respect to the rod in which the edges of the aperture in the plate grip the rod to prevent return movement of the rod when operative movement ceases, and lock releasing means comprising a pivoted lever having an abutment means positioned to engage the plate of said locking means to hold said plate in an orientation substantially perpendicular to the rod to allow the rod to slide freely through the aperture.

One presently preferred form of the invention will now be described with reference to the accompanying drawings in which.

Figure 1:
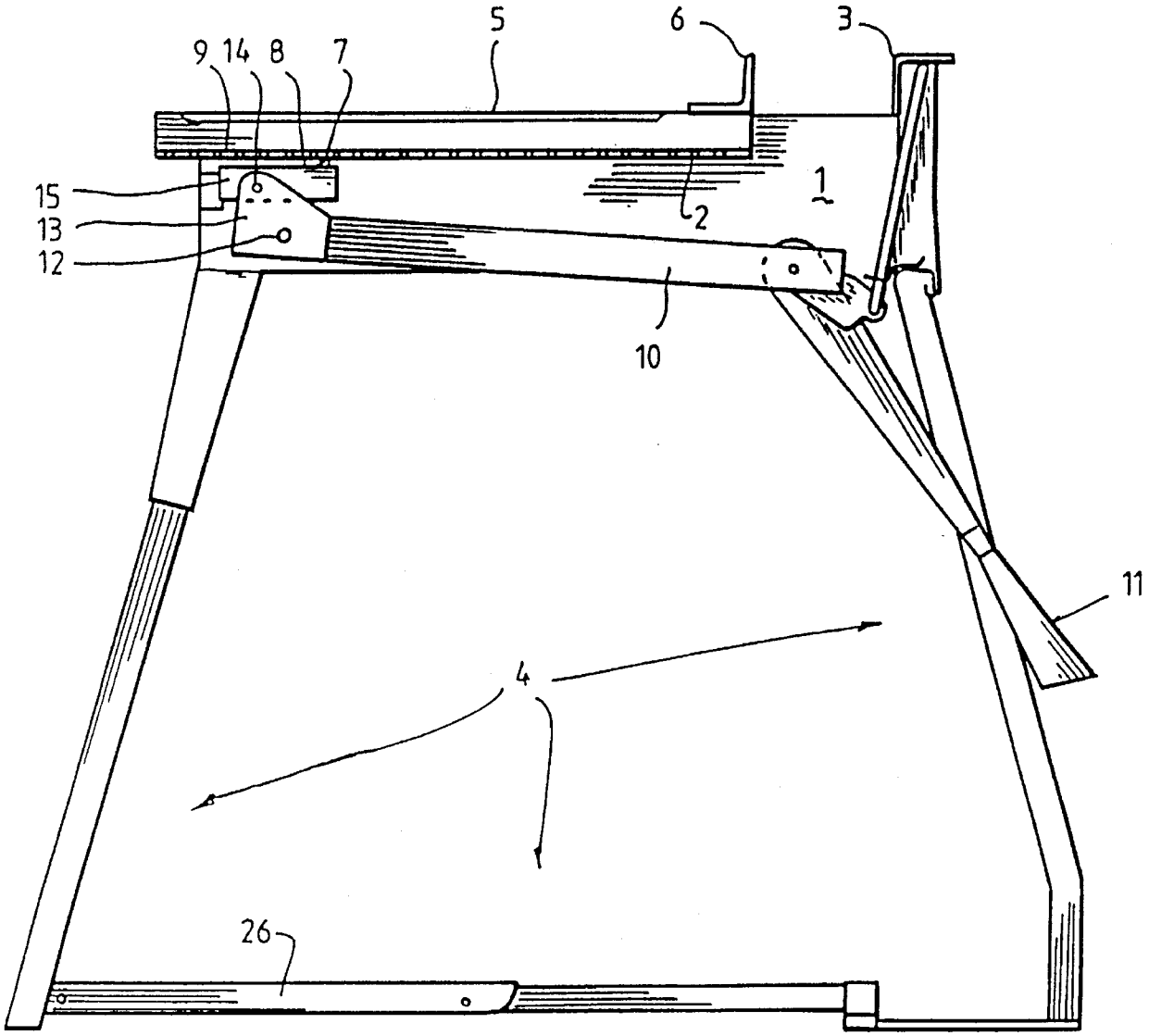
FIG. 1 is a partially sectional side elevation of a clamping device embodying the invention.

Referring first to FIG. 1, the device comprises a support structure 1 which incorporates an integral track 2 and a fixed jaw 3. The support structure 1 is supported by a foldable frame 4 (see FIG. 3 for greater detail).

The support structure track 2 is adapted to receive a back runner 5 having an integral moving jaw 6. The back runner is adapted to freely travel back and fourth along the track 2 and is also capable of complete removal and reversal thereby facilitating a very broad range of jaw openings. The vice operation of the jaws is in a positive direction with the back runner being engaged by an advancing member 8. The engagement of the back runner is effected by forward facing pawls 7 on the surface of the advancing member 8 which are specifically adapted through the bias of spring 15 to engage apertures 9 in the back runner 5. The apertures 9 in the back runner are adapted for bi-directional engagement to allow the runner to be reversed for extended jaw capacity, and in the present embodiment there are two rows of generally square apertures engaged by spaced pairs of pawls 7.

The operation of the advancing member 8 is effected by an articulated connection to a foot operated lever means 10. The lever has a front foot pedal 11 located at the operative end, and a rear pivot 12 to the support structure 1. The foot lever is terminated by a cranked lever 13 which is pivotally connected to the advancing member 8 by pivot 14 so as to effect an advancing action substantially parallel to the direction of travel of the back runner 5 in the track 2. The advancing member 8 is freely pivoted to the cranked lever 13 but is biased by a spring 15 which tilts the advancing member to effect engagement of the pawls to the apertures of the back runner. The action of the advancing member is further restrained by interaction with an abutment finger 16 (see FIG. 2) which is positioned to partially withdraw the advancing member against the bias of the spring upon release of the foot lever (see FIG. 3). This action allows the pawls 7 to disengage the apertures 9 of back runner 5 and facilitates rapid advancing, retraction, removal or the reversal of the back runner 5 and moving jaw 6.

Activation of the foot operated lever 10 causes the advancing member 8 to move forward, off the finger 16, and lift up by action of the spring 15 to engage the apertures 9 of the back runner 5. Further activation of the foot lever moves the advancing member 8 forward which causes the back runner 5 and moving jaw 6 to advance toward the fixed jaw 3. Once the full operating span is reached, the lever 10 is returned to its rest position by spring 30 (see FIG. 2) causing the advancing member to disengage the back runner (as previously described) and reverse back along the back runner, with the back runner remaining stationary due to friction, to a further point of engagement where another activating operation can further advance the moving jaw. This operation is repeated until the jaws engage the object to be secured.

Figure 2:
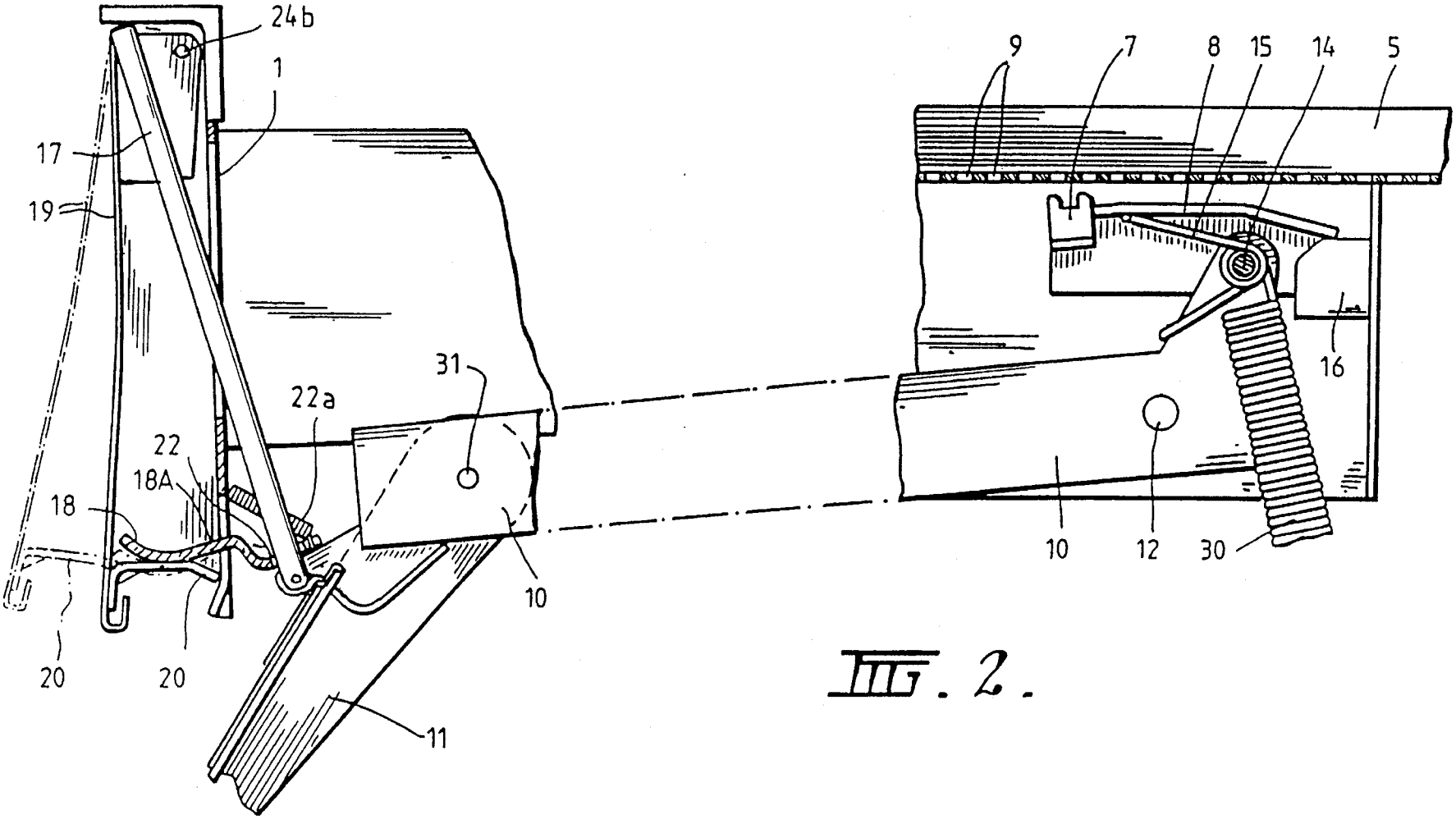
FIG. 2 is a fragmentary sectional elevation of the device showing the locking and advancing mechanisms of the device.

Referring now to FIG. 2, the foot operated lever further incorporates a locking mechanism located near the front foot pedal 11. The locking mechanism is located near the pedal end of the foot lever 10 to minimise the forces required to lock the jaws at a given pressure.

The locking mechanism comprises a rod 17 pivotally attached to the foot lever 10 and passing through an aperture 22 in a locking plate 18 positioned to effect a substantially tangential movement of the rod relative to the pivoting action of the foot lever 10. The locking plate comprises a pivoting, hardened steel locking plate 18 having an aperture 22 of greater diameter than the rod (FIG. 2), through which the rod 17 passes. The locking plate 18 is pivoted to the support structure 1 at 18*a* and is biased by a spring 22(*a*) to the locking position shown in broken outline in FIG. 2 such that movement of the rod 17 through the aperture 22 is normally limited to one direction only, said direction following the activation direction of the lever arm. As such, the locking plate provides a locking mechanism allowing the continuous and infinitely variable locking of the lever at any desired position. The mechanical advantage of the lever 10 and the continuous nature of the locking action ensure exquisitely fine control over the clamping pressure of the jaws whilst the very same mechanical advantage facilitates the availability of very high clamping pressure, if such pressure is required. Furthermore, the action of the advancing member 8 allows repeated advancement of the jaw 6 to operate in the manner of a press to perform pressing, bending or cropping off operations.

The locking plate 18 is released by pivoting the locking plate 18 against the action of the biasing spring 22(*a*) to the position shown in solid outline in FIG. 2. A lock releasing plate 19 or lever is pivoted to support structure 1 and has an abutment 20 which engages the plate 18 to effect such release. The locking plate 18 is shaped to enable the abutment 20 to hold the plate 18 in the released position, as shown in solid outline in FIG. 2, to allow free travel of the rod and lever arm.

Figure 3:
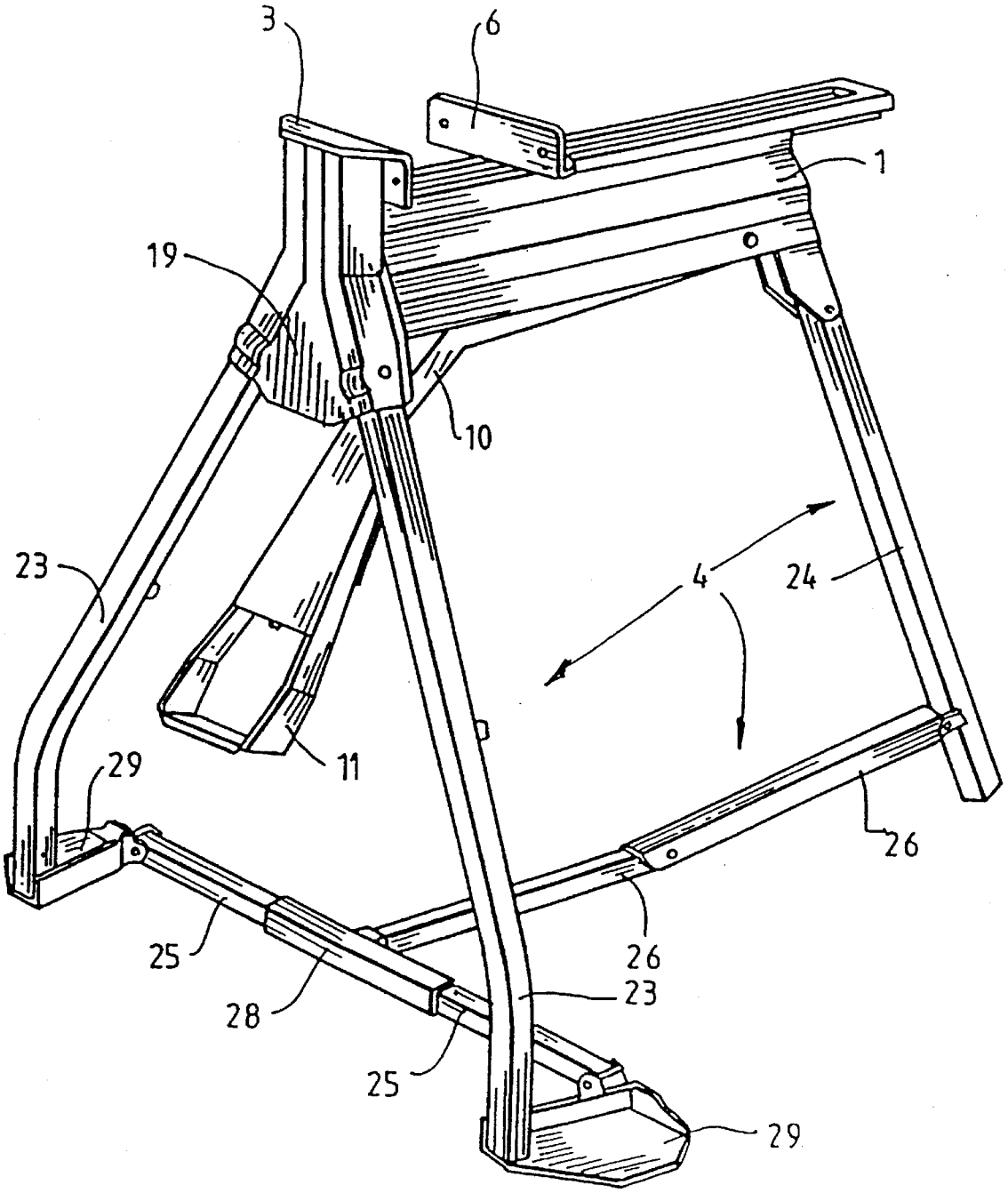
FIG. 3 is a perspective view from the front of the device of FIG. 1 showing the collapsible supporting frame in greater detail.
Figure 4:
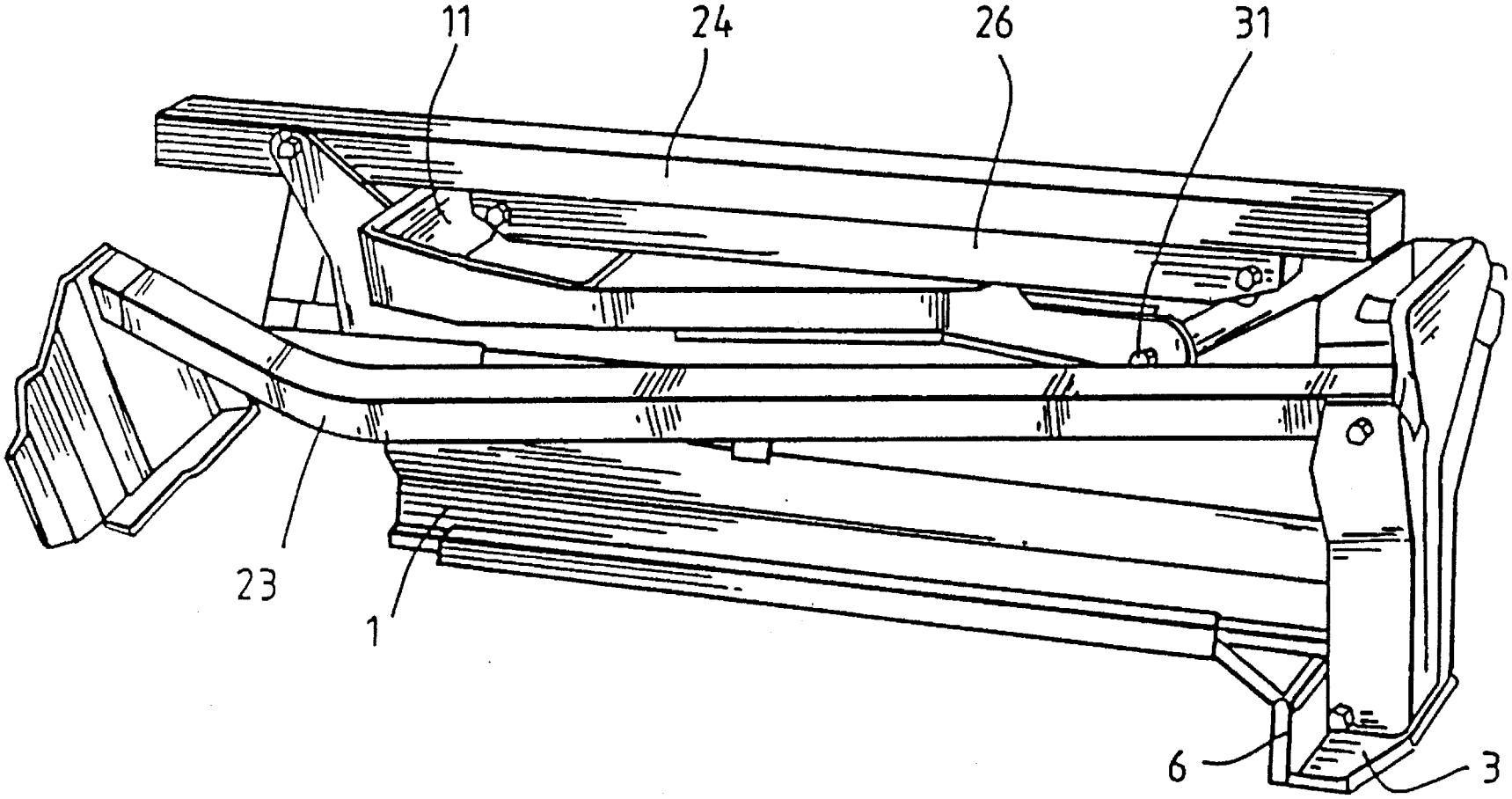
FIG. 4 is a perspective view of the device in the folded condition.

The foldable frame 4 includes foldable support legs as detailed in FIGS. 3 and 4 where two front legs 23 are pivotally connected to the support structure 1 and straddle either side of the support structure 1. The two front legs 23 are fixed into the erect position by a bracing strut 25 comprising two struts joined at the centre by a locating housing 28. The rear leg 24 is pivoted from the rear of the support structure and is adapted to rigidly support the rear of the device being located in the erect position by a rear bracing strut 26 having a two part hinged construction joining the rear leg and the locating housing 28 of the front bracing strut 25. The rear bracing strut is positioned by forcibly opening the hinge to establish full strut length thereby placing the three legs under tension and rigidly establishing a very sturdy erect structure. The front legs 23 have foot plates 29 at their lower ends, to which the struts 25 are pivoted, to allow the frame 4 to be additionally stabilized by the user standing on one of the plates 29, or on the struts 25 and 26.

In the foldable mode shown in FIG. 4, the front legs fold back along the sides of the support structure and the rear leg folds up to lie along the length of the support structure and the lever 10 is folded about a pivot connection 31 as shown, to also lie along the length of the support structure to effect a compact and readily transportable unit.

From the foregoing it can be seen that the instant invention provides a highly versatile clamping device incorporating a number of unique features. The device provides a very broad range of clamping capacities by virtue of the reversible jaws. The leverage mechanics offer a high mechanical advantage which supplements the power available by operation to provide a device capable of very substantial clamping pressure or pressing force. The locking mechanics allow a continuous and infinitely variable lock for the clamp which allows locking at any position. The result of this feature is that jaws may be quickly locked at any position and at any pressure. The collapsible legs offer the device a high degree of portability whilst having suitable bracing to ensure a very rigid structure upon erection.

The claims form part of the disclosure of this specification.

We claim:

1. A clamping device comprising a support structure carrying two adjustably spaced apart jaws, lever means pivotally connected to the support structure and operably engaging advancing means for moving one of the jaws relative to the other as the lever means is pivoted to a selected position to apply a selected clamping force to an object between said jaws determined by the force applied to the lever, and locking means for holding the two jaws in any selected position with said selected clamping force applied to the object, said locking means allowing the continuous and infinitely variable locking of said clamping device in any selected position and selected clamping force, said locking means comprises a first member adapted to frictionally engage a second member in an infinitely variable manner to hold the jaws in any selected position, said first member of said locking means comprises a plate pivoted to the support structure, said plate having an aperture, said second member comprising a rod connected to the lever means, said rod passing freely through said aperture when the plate is substantially perpendicular to said rod, said plate being spring biased to an angular position with respect to the rod so that the plate frictionally grips the rod when advancing movement of the lever ceases to prevent return movement of the lever and thereby to lock the advancing means and the jaws in any selected position.

2. The clamping device of claim 1 further comprising lock releasing means co-operating with said locking means holding the locking means in its deactivated state to allow the lever means to be reciprocated to repeatedly actuate the advancing means to reduce the space between the jaws in 'hands-free' manner.

3. The clamping device of claim 2, wherein the lock releasing means comprises a lever pivoted to the support structure and having an abutment means positioned to engage the plate of said locking means to hold said plate substantially perpendicular to the rod to allow the rod to slide freely through the aperture.

4. The clamping device of claim 3 wherein one jaw is fixed relative to the support structure during the clamping operation, and the other jaw is a movable jaw mounted on the support structure for movement towards said fixed jaw during the clamping operation.

5. The clamping device of claim 4 wherein the other jaw is removable from the support structure and selectively replaceable thereon in an orientation in which the other jaw is selectively at one or other end of the support structure to vary the maximum space between the jaws.

6. The clamping device of claim 4 wherein the other jaw is carried by an elongate back runner configured to engage a track formed in the supporting structure and having an array of spaced apertures, teeth or abutments formed along the length of the back runner, said advancing means including an advancing member having means to engage the apertures, teeth or abutments in said back runner, said advancing member being pivotally attached to the end of said lever means and being spring biased to cause arcuate movement of said advancing member towards the said back runner to cause engagement between said engagement means and said array of apertures, teeth or abutments when the lever means is pivoted in the operative direction, and an abutment finger carried by said support structure for engaging the rear end of said advancing member when the lever is in its rest position to pivot the advancing member against the action of said spring biasing to position the engagement means clear of the back runner to facilitate free sliding movement of said moving jaw with respect to said support structure.

7. A clamping device according to claim 6 wherein said engagement means comprises upstanding pawls formed to engage apertures in said back runner and each of the pawls is formed to engage a portion of the back runner surrounding the aperture engaged by each pawl to ensure positive engagement with said back runner.

8. A clamping device according to claim 7 wherein the support structure comprises an elongate portion defining a track for slidably receiving said other jaw, and three legs pivotally attached to the elongate portion and comprising two legs pivoted to the elongate portion at the front of the support portion and one leg pivotally mounted at the rear end of the support portion, and collapsible bracing struts extending between said front legs and between said front leg bracing strut and said rear leg to releasably retain said legs in their supporting positions, said front legs being collapsible to lie along either side of the elongate support portion and said rear leg, lever arm and pedal being collapsible to lie along the length of the support portion to facilitate collapsing of the support structure into an easily transportable or stowable form.

9. A clamping device according to claim 8 wherein the front legs have enlarged feet secured to their lower ends and to which the bracing struts are pivotally attached, said feet being positioned to enable the operator to stand on the feet to stabilize the support structure.

10. A clamping device comprising two adjustably spaced apart jaws carried by a support structure, a continuously acting pivoted lever means carrying advancing means for advancing at least one of said jaws relative to the other jaw, said advancing means including an advancing member having means to engage spaced apertures, teeth or abutments in an elongate back runner of one of said jaws, said advancing member being pivoted to the inner end of said lever means and being spring biased to cause arcuate movement of said advancing member towards the back runner to cause engagement between said engagement means and said spaced apertures, teeth or abutments when the lever means is pivoted in the operative direction, and an abutment finger carried by said support structure for engaging the rear end of said advancing member when the lever is in its retracted position to pivot the advancing member against the action of said spring biasing to position the engagement means clear of the back runner to facilitate free sliding movement of said one of said jaws with respect to said support structure.

11. A clamping device according to claim 10 wherein said lever means is spring biased to return to its rest position.

12. A support structure for a clamping workbench, comprising an elongate support carrying two adjustably spaced apart jaws, foot operated lever means pivotally connected to said support and having a foot pedal, said lever means operably engaging advancing means for moving one jaw relative to the other, two front support legs pivotally mounted to the elongate support at the one end of the support and one rear support leg pivotally mounted at the other end of the support, collapsible bracing struts extending between said front legs and between said front leg bracing strut and said rear leg to releasably brace said legs in their supporting positions, said front legs being collapsible to lie along either side of the elongate support and said rear leg, said lever arm and said foot pedal being collapsible to lie along the length of the support to facilitate collapsing of the support structure into an easily transportable form.

13. A support structure according to claim 12 wherein the front legs have enlarged feet secured to their lower ends and to which the bracing struts are pivotably attached, said feet being positioned to enable the operator to stand on the feet to stabilize the support structure.

14. A clamping device according to claim 11 wherein said advancing means is configured to leave said at least one of said jaws free for adjustable movement with respect to said support structure to enable rapid advancement of the jaws towards each other.

15. A clamping workbench comprising a support structure carrying two adjustably spaced apart jaws, foot operated lever means pivotally connected to the support structure and having a foot pedal, said lever means operably engaging advancing means for moving one of the jaws to a selected position relative to the other as the lever means is pivoted to apply a selected clamping force to an object between said jaws determined by the force applied to the lever means, and locking means for holding the lever means in any said selected position with said selected clamping force applied to the object, said locking means comprising a first member mounted on said support to lockably engage a second member on said lever means, leg means foldably carried by said support structure for supporting said support structure in a stable manner at an elevated position relative to a supporting surface, said leg means said lever means and said foot pedal being collapsible so as to be positioned adjacent to and along said support structure to render the workbench readily portable or stowable, said second member of said locking means being pivoted to said lever means to allow said lever means to be collapsed without disconnecting said locking means.

16. The clamping workbench of claim 15, wherein said first and second members of said locking means are housed substantially within said support structure to allow the workbench to be collapsed.

17. The clamping workbench of claim 15 or 16, wherein one of said jaws is fixed at one end of said support structure and said first and second members are partly housed within said fixed jaw structure.

18. The clamping workbench of claim 16, further comprising lock releasing means comprising a lever pivoted to said support structure and configured to enclose said first and second members within said support structure, said lever having an abutment which engages said first members to hold it in a released position relative to said second member to allow repeated 'hands-free' actuation of said lever means without locking.

19. The clamping workbench of any one of claims 15, 16 or 18, wherein said leg means comprises a pair of legs pivoted to one end of said support structure and a single leg pivoted to the other end of said support structure, and collapsible bracing struts extending between and interconnecting said legs.

20. The clamping workbench of claim 19, wherein said lever means comprises a first portion pivoted to said support structure and a second downwardly depending portion foldably connected to a free end of said first portion, said second member of said locking means pivotally engaging said first portion of said lever means to allow said lever means to be collapsed without detaching said locking means from said lever means.

21. The clamping workbench of claim 20, wherein said first member of said locking means frictionally engages said second member in an infinitely variable manner.

22. A clamping device comprising a support structure carrying two adjustably spaced apart jaws, lever means pivotally connected to the support structure and operably engaging advancing means for moving one of the jaws relative to the other as the lever means is pivoted to a selected position to apply a selected clamping force to an object between said jaws determined by the force applied to the lever means, locking means for holding the two jaws in any selected position with said selected clamping force applied to the object, said lever means having an operative end to which operating forces are applied, said locking means acting between said support structure and said lever means at a position which is closer to said operative end of the lever means than its pivotal connection to the support structure.

23. A clamping device comprising a support structure carrying two adjustably spaced apart jaws, lever means pivotally connected to the support structure and operably engaging advancing means for moving one of the jaws relative to the other as the lever means is pivoted to a selected position to apply a selected clamping force to an object between said jaws determined by the force applied to the operative end of the lever means, locking means for holding the two jaws in any selected position with said selected clamping force applied to the object, lock releasing means cooperating with said locking means to release said locking means from its activated state, said lock releasing means comprising a lever pivoted to said support structure in proximity to the operative end of said lever means to facilitate hands-free operation of said lock releasing means by means of the knee of the operator.

24. The clamping device of claim 23 wherein said lock releasing means cooperates with said locking means holding the locking means in its deactivated state to allow the lever means to be reciprocated to repeatedly actuate the advancing means to reduce the space between the jaws in a "hands-free" manner.

25. The clamping device of claim 24 wherein said lock releasing means has an abutment means positioned to engage a locking plate of said locking means to hold said plate substantially perpendicular to the rod to slide freely through the aperture.

26. A clamping device comprising an elongated support structure having first and second end portions, a clamping jaw fixed to said first end portion with its jaw surface facing said second end portion, said support structure having a supporting track extending from said fixed jaw to said second end portion, a back runner including a jaw mounted at one end and slidably supported on said supporting track for reciprocating motion toward and away from said fixed jaw, said back runner having a series of driving abutments along the length thereof, an elongated lever pivotally mounted on said structure at said second end portion and terminating in a foot operated extension below said first end portion, said elongated lever terminating in a crank arm on the opposite side of its pivotal mounting on the supporting structure from the foot operated extension, a ratchet mechanism including ratchet teeth pivotally mounted on said crank arm and biased for engagement with said driving abutments of said back runner whereby rocking motion of said lever around said pivotal mounting on said support structure ratchets said back runner and attached jaw into clamping relationship with said fixed jaw; and a locking mechanism on said support structure first end portion and said elongated lever to lock said elongated lever at a predetermined clamping pressure.

27. A clamping device as claimed in claim 26 wherein said elongated support structure having first and second end portions is positioned above a substantially horizontal support surface by three spaced legs, two of said legs angularly depending from said first end portion while the third leg angularly depends from said second end portion to define a three point support, bracing struts interconnecting said legs to stabilize said three point support, said legs being pivotally joined to said support structure and said bracing struts being foldable with respect to said legs whereby the three point support can be collapsed to lie against the elongated support structure.

* * * * *

UNITED STATES PATENT AND TRADEMARK OFFICE

CERTIFICATE OF CORRECTION

PATENT NO. : 5,524,872

DATED : June 11, 1996

INVENTOR(S) : Lewin et al

It is certified that error appears in the above-indentified patent and that said Letters Patent is hereby corrected as shown below:

Column 9, line 28, "members" should be --member--.

Signed and Sealed this

Tenth Day of September, 1996

Bruce Lehman

*Attest:*

BRUCE LEHMAN

*Attesting Officer*

*Commissioner of Patents and Trademarks*